United States Patent [19]

Chase et al.

[11] 4,409,853

[45] Oct. 18, 1983

[54] PULP SAMPLING SYSTEM

[75] Inventors: Richard R. Chase, Savannah, Ga.; Franklin N. Rhoad, Bluffton, S.C.

[73] Assignee: Union Camp Corporation, Wayne, N.J.

[21] Appl. No.: 293,481

[22] Filed: Aug. 17, 1981

[51] Int. Cl.[3] ..... D21F 1/08

[52] U.S. Cl. ..... 73/863; 73/63; 73/432 R; 162/49; 162/263

[58] Field of Search ..... 73/63, 426, 432 Z, 863; 137/467.5, 4, 92, 91; 162/49, 258, 263

[56] References Cited

U.S. PATENT DOCUMENTS 2,674,256 4/1954 Ullman ..... 137/92
3,705,078 12/1972 Shinohara ..... 137/92

FOREIGN PATENT DOCUMENTS 1498723 11/1969 Fed. Rep. of Germany ..... 73/63
565976 10/1977 U.S.S.R. ..... 73/63

OTHER PUBLICATIONS

TAPPI Standard T236-05-76, "Kappa Number of Pulp", Official Standard-1976.
"Low Consistency Stock Transmitter LCM-77", Electron Machine Corp.

*Primary Examiner*—James J. Gill
*Assistant Examiner*—Brian Tumm
*Attorney, Agent, or Firm*—Kane, Dalsimer, Kane, Sullivan and Kurucz

[57] ABSTRACT

A pulp sampling device for combining pulp and water to form a pulp suspension and circulating the suspension until an exact volume of a sample of the suspension has attained a targeted meter reading of consistency and concentration which volume of pulp can be used for Kappa number determination or like tests.

5 Claims, 1 Drawing Figure

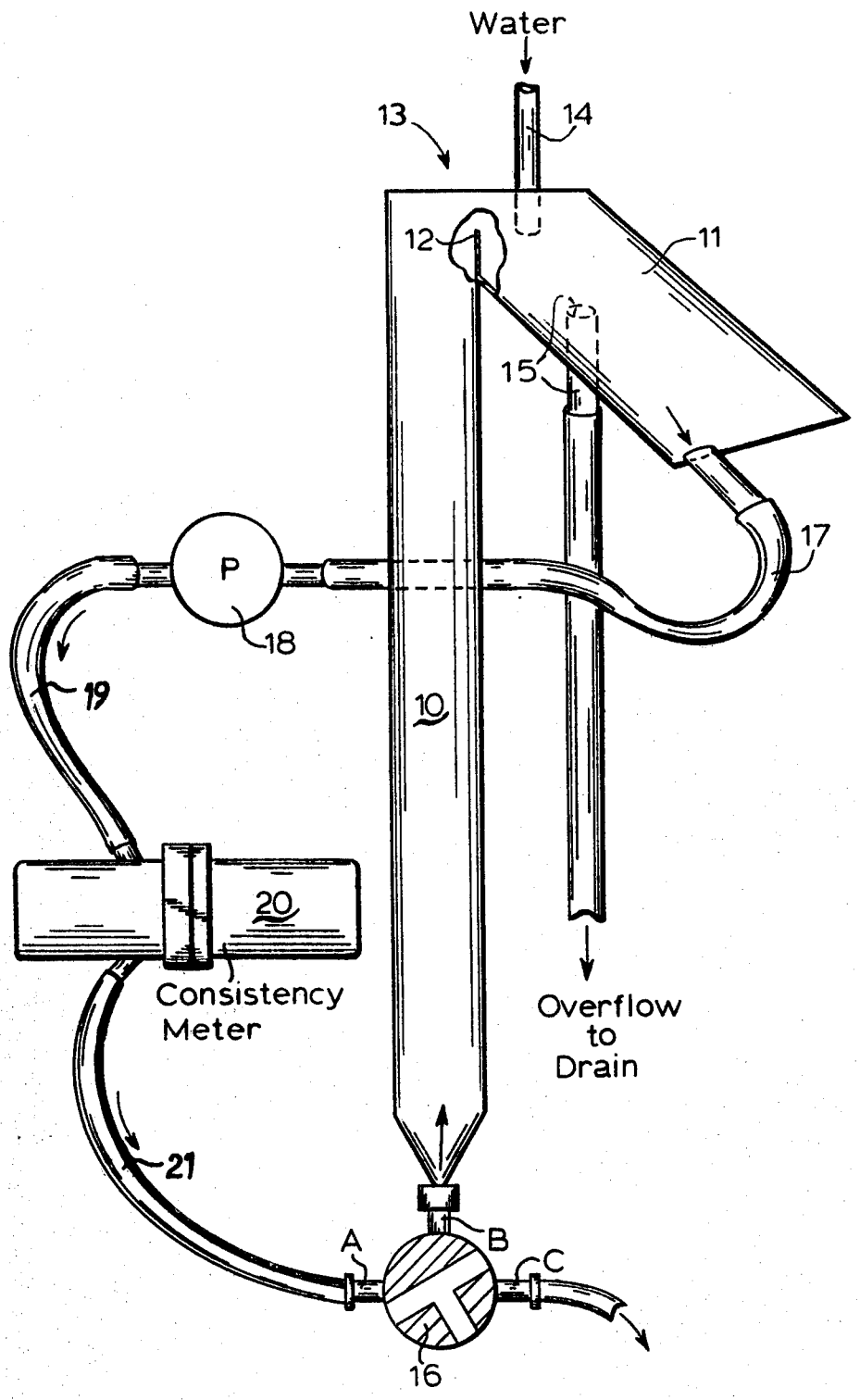
Water
13
14
12
11
15
17
P
18
19
10
20
Consistency
Meter
Overflow
to
Drain
21
A
B
C
16

PULP SAMPLING SYSTEM

BACKGROUND OF THE INVENTION

1. Field of the Invention

The invention relates to a pulp sampling system for determination of the degree of the delignification of pulp and can be used for all routine Kappa number tests or other similar tests on pulp samples taken prior to and after entering the paper mill refining system. The pulps included are blowline, washer, and decker pulps, inlet pulp to the first paper mill refiner, as well as refined pulps up to the paper machine driers. More particularly, the invention relates to an accurate and reproducible means of obtaining an exact amount of pulp suspension of a desired consistency and concentration for Kappa number determination or like tests.

2. Brief Description of the Prior Art

The Kappa test in the pulp and paper industry is established and well known. The standard test will be found in the Official Standard for Pulp Testing—TAPPI Standard T236OS-76. TAPPI is the Technical Association of the Pulp and Paper Industry having its headquarters at One Dunwoody Park, Atlanta, Ga. 30338. The Kappa number is the number of cubic centimeters of 0.1 N potassium permanganate solution consumed by one gram of moisture-free pulp under the conditions specified in the procedure. The results are corrected to 25° C., and to 50 percent consumption of the permanganate added. An alternate test currently used with the pulp sampling system is a modification of the above mentioned TAPPI Standard Kappa Test which uses a Waring blender for further pulp refining, and a reduced reaction time (5 minutes compared to 10 minutes in the TAPPI Standard).

Currently the pulp sample to make such test is obtained by means of a time-consuming and potentially quite inaccurate "dip and pour" technique, which involves pouring refined pulp into a large bucket, diluting to 10 liters, and agitating with a large mixer until homogeneous, after which a consistency is obtained by dipping a known volume out of the bucket and measuring the dry weight of the pulp so obtained. The volume needed to deliver the set weight of pulp is then calculated, and a second volume is dipped out of the bucket for use in the test.

The system of the present invention eliminates the "dip and pour" technique and provides the means for obtaining automatically an exact volume of pulp of a certain consistency and concentration which volume of pulp can be used in the actual Kappa number titration itself.

SUMMARY OF THE INVENTION

The invention comprises a device and method for obtaining an exact volume of a sample of a pulp suspension having a desired consistency and concentration for testing comprising;

a sample chamber designed to hold a specified volume of suspension;

a consistency meter having a readout to show the consistency of the suspension going through the meter;

a pump to circulate the suspension through the system;

a three way valve;

the chamber, meter, pump and valve being interconnected so that the suspension can be circulated through the chamber and the meter;

means to add pulp and water to the system until the meter readout shows the consistency of the suspension has reached a reading targeted for the tests to be performed; and means to turn off the circulation and drain the volume of suspension from the chamber for testing.

BRIEF DESCRIPTION OF THE DRAWINGS

In the drawings:

FIG. 1 is a side elevational view of the apparatus for the pulp sampling system of the present invention.

DETAILED DESCRIPTION OF THE PREFERRED EMBODIMENTS OF THE INVENTION

Referring to the drawings, there is shown in FIG. 1 a sample chamber 10 mounted in a vertical position. Such chamber can be made of plastic, metal, glass or like material. Secured to the top of the chamber 10 is an outlet tube 11 with a weir 12 interposed between the chamber and outlet tube so that liquid and pulp can drain from the top of the chamber over the weir into the outlet tube. The tops 13 of the chamber 10 and the outlet tube 11 are open so that pulp can be fed into the system at 11 or 13 and so that water can be fed through a tube 14 into the system. Either the pulp or the water can be added at any convenient location in the system. Such tube 14 may be connected to a solenoid water input switch (not shown). The outlet tube 11 may be provided with an overflow 15 to a drain. The bottom of the chamber 10 is connected to a 3-way ball valve 16 to permit either the sample to be removed from the bottom of the chamber or the pulp-water mixture to be fed into the bottom of the chamber during circulation of the mixture through the system. Such 3-way valve can be positioned to (a) connect lines A and B with line C closed, or (b) connect lines B and C with A closed. The chamber 10 serves the dual purpose of insuring the reproducible collection of a known volume of pulp and of allowing for adequate pulp and water mixing.

One successful embodiment provides that the outlet tube 11 is connected to a tube 17 running from the outlet tube to an impeller pump 18 (one satisfactory type is sold under the trademark JABSCO) which circulates the pulp suspension through the system and the sample chamber at the desired speed. The pulp suspension flows through a tube 19 from the impeller pump 18 to a consistency meter 20 (of the type LCM-77, manufactured by Electron Machine Corporation). The consistency meter 20 is designed for continuous measurement of the concentration of suspended particles which have the ability to depolarize light, such as cellulose fibers in water. This is accomplished in the process stream by passing a representative portion of the main stream through a sample cell, through which a polarized light beam is transmitted and analyzed to determine the amount of depolarization created by the suspended particles. The signal obtained, which is representative of the amount of depolarization, is conditioned to indicate the percent concentration or consistency of the particle, with direct readout for indication, recording or control purposes. The consistency meter 20 is provided with a digital readout to give the necessary readings for the particular type of pulp being circulated through the system. Since the consistency transmitter response varies with the Kappa number (that is the meter varies with changes in the parameter being measured), it is necessary to do a different calibration for each pulp type. The meter 20 is connected through a tube 21 to the 3-way ball valve 16.

The following procedure can be followed in collecting a sample for the Kappa number titration:

(a) The sample chamber 10 is filled to overflow level with fresh water using the water solenoid control switch. At this stage the 3-way ball valve is set to permit flow from the tube 21(A) to the bottom (B) of the chamber with the outlet (C) closed.

(b) The pump 18 is turned on and the water is allowed to circulate 15 seconds.

(c) At this stage the digital readout of the consistency meter should be checked to make sure that the reading is at zero ±1.0. If the instrument is not at zero ±1.0 fresh water shoud be added to rinse out system until zero is reached.

(d) Pulp is added to the sample chamber in small amounts until the digital readout for the pulp suspension is at the $LCM^t$ (targeted reading) that would produce the weight of OD (oven-dry) fiber necessary to allow the final permanganate titration to be within ±20% of 50% consumption. Of various type pulp grades, the following are illustrative:

| Pulp | Digital Readout - $LCM^t$ |
|---|---|
| Kraft Pine Pulp in yield range 53–58 | 60 |
| Kraft Pine Pulp in yield range 48–53 | 95 |
| Kraft Pine Pulp in yield range 44–48 | 170 |
| Kraft Hardwood Pulp in yield range 47–49 | 300 |

Fresh water should be added to the top of the outlet tube 11, if necessary to reach and maintain readout at $LCM^t$.

(e) The digital readout should remain at $LCM^t$ ±0.5 for 30 seconds before sample for titration is taken.

(f) Simultaneously the pump 18 is turned off and the 3-way ball valve 16 is turned to the STOP position. This closes the flow from the tube 21(A) to the bottom of the chamber with the outlet (C) still closed.

(g) The Kappa titration reaction vessel is placed in position under the 3-way ball valve and the valve is slowly opened to allow the sample to drain from the chamber into a sample container. Steps should be taken to make sure that all of the sample has been drained from the chamber to the container.

(h) The 3-way ball valve is turned to the OPEN position.

In this procedure the pipe valves for feeding in the pulp and water and the three-way valve can be operated manually according to the digital readout or the pipes can be opened and closed and the valve turned by electrical means connected to the digital readout for automatic operation.

The embodiment heretofore described may be varied by locating the pump 18 either between the outlet 11 and the consistency meter 20 or between the consistency meter 20 and the valve 16.

The volume of 950 mls was set to match the volume needed for the Kappa number test described. A different volume could be used if required in the test being run without any problems. At a set consistency, different volumes would simply deliver differing total weights of pulp due to the volume change.

Although the procedure has been described for Kappa number tests it will be understood that pulp samples of a certain consistency and concentration can be obtained with this apparatus and by this method for other tests, such as the permanganate number of pulp, the chlorine number of pulp, consistency itself, or any other applications where the pulp being tested requires a certain consistency and concentration for test.

Those skilled in the art will appreciate that many variations of the above described embodiment of the invention may be made without departing from the spirit and scope of the invention.

What is claimed is:

1. A device for obtaining an exact volume of a sample of a pulp suspension having a desired consistency and concentration for testing comprising:

a sample chamber designed to hold a specified volume of suspension, the said chamber having an opening at the top for the suspension to flow out and an opening at the bottom for suspension to flow in whereby the suspension can circulate through the chamber;

an outlet tube at the top of the chamber with a weir interposed between the chamber and the outlet tube over which the suspension can flow from the top of the chamber into the outlet tube, the said outlet tube having an outlet to permit the suspension to flow from the outlet tube;

a pump to circulate the suspension which can be turned off to stop circulation;

overflow means to exhaust any excess from the circulating suspension;

a consistency meter having a readout to show the consistency of the suspension going through the meter;

a three-way valve connected to the bottom of the chamber which can be turned to permit the suspension to flow into the chamber, the flow of suspension to be stopped, or to be drained from the chamber;

the said outlet tube, pump, consistency meter, three-way valve and the bottom of the chamber being interconnected so that the pump can circulate suspension continuously through the chamber and meter;

means to add pulp and water to the circulating suspension as needed until the meter readout shows the consistency of the suspension has reached a reading targeted for the tests to be performed;

and means to drain the volume of suspension from the chamber for testing after the circulation and flow of suspension into the chamber has stopped.

2. The device of claim 1 to obtain a pulp suspension sample for Kappa number tests in which the sample chamber has a volume of 950 ml. and the reading targeted will be between 60 and 300 depending on paper or board to be made from the pulp.

3. The device of claim 1 in which the pulp is added to the top of the sample chamber.

4. The device of claim 1 in which the water is added to the top of the outlet tube.

5. The device of claim 1 in which the three-way valve is affixed to the bottom of the sample chamber.

* * * * *